US010100552B2

(12) United States Patent
Wheeler

(10) Patent No.: US 10,100,552 B2
(45) Date of Patent: Oct. 16, 2018

(54) LOCK ASSEMBLY WITH AN INTERCHANGEABLE LOCK CORE

(71) Applicant: Hanchett Entry Systems, Inc., Phoenix, AZ (US)

(72) Inventor: Thomas J. Wheeler, Pomona, CA (US)

(73) Assignee: Hanchett Entry Systems, Inc., Phoenix, AZ (US)

( * ) Notice: Subject to any disclaimer, the term of this patent is extended or adjusted under 35 U.S.C. 154(b) by 0 days.

(21) Appl. No.: 15/269,225

(22) Filed: Sep. 19, 2016

(65) Prior Publication Data

US 2017/0002587 A1 Jan. 5, 2017

Related U.S. Application Data

(63) Continuation of application No. 13/737,580, filed on Jan. 9, 2013, now Pat. No. 9,476,226.
(Continued)

(51) Int. Cl.
*E05B 9/00* (2006.01)
*E05B 63/00* (2006.01)
(Continued)

(52) U.S. Cl.
CPC ..... *E05B 9/002* (2013.01); *E05B 9/04* (2013.01); *E05B 9/08* (2013.01); *E05B 9/084* (2013.01); *E05B 17/0004* (2013.01); *E05B 63/0056* (2013.01); *E05B 9/086* (2013.01); *E05B 63/0013* (2013.01); *Y10T 29/49817* (2015.01); *Y10T 29/49826* (2015.01); *Y10T 70/5155* (2015.04)

(58) Field of Classification Search
CPC ... E05B 9/00; E05B 9/002; E05B 9/04; E05B 9/048; E05B 9/08; E05B 9/084
See application file for complete search history.

(56) References Cited

U.S. PATENT DOCUMENTS 2,101,812 A 12/1937 Kistner
3,429,154 A 2/1969 Schwartz
(Continued)

OTHER PUBLICATIONS

Byrne, Gerard, "Examination Report Under Section 18(3)," dated Mar. 29, 2016 for United Kingdom Application No. GB1300430.4, United Kingdom Intellectual Property Office.
(Continued)

*Primary Examiner* — Christopher J Boswell
(74) *Attorney, Agent, or Firm* — Woods Oviatt Gilman LLP; Ronald J. Kisicki, Esq.

(57) ABSTRACT

An interchangeable core assembly for a lock core assembly capable of being flush mounted in a door including a housing, a lock insert mounted in the housing, a lock core mounted in the housing adjacent to and cooperative with the lock insert, a thumb-turn assembly mounted in the non-cylindrical housing coaxial with the lock core, a first offset cam mounted on the thumb-turn assembly for rotation therewith, and a second offset cam mounted on the lock core for rotation therewith. The barrel of the lock core assembly is unobstructed by locking train components such that the lock core assembly extends completely through the latch assembly when installed therein. The lock core assembly is secured to the latch assembly without threads and a means to remove/replace the thumb-turn component is provided.

13 Claims, 11 Drawing Sheets

Related U.S. Application Data

(60) Provisional application No. 61/584,931, filed on Jan. 10, 2012.

(51) Int. Cl.

| | |
|---|---|
| ***E05B 17/00*** | (2006.01) |
| ***E05B 9/08*** | (2006.01) |
| ***E05B 9/04*** | (2006.01) |

(56) References Cited

U.S. PATENT DOCUMENTS

| | | | | | |
|---|---|---|---|---|---|
| 3,473,356 | A | | 10/1969 | Kalervo | |
| 3,713,311 | A | | 1/1973 | Oliver et al. | |
| 4,099,397 | A | * | 7/1978 | Dauenbaugh | E05B 9/084 70/371 |
| 4,708,007 | A | * | 11/1987 | Stoia | E05B 9/08 70/417 |
| 4,726,206 | A | * | 2/1988 | Hsu | E05B 9/084 109/38 |
| 4,843,852 | A | | 7/1989 | Foshee et al. | |
| 4,995,249 | A | | 2/1991 | Preissler et al. | |
| 5,087,090 | A | | 2/1992 | Humphrey et al. | |
| 5,291,767 | A | | 3/1994 | Weindorf et al. | |
| 5,339,663 | A | | 8/1994 | Doring | |
| 5,622,065 | A | * | 4/1997 | Persiano | E05B 9/08 292/195 |
| 5,752,399 | A | | 5/1998 | Shen | |
| 5,775,145 | A | | 7/1998 | Kasper | |
| 5,873,272 | A | * | 2/1999 | Thompson | E05B 9/084 70/100 |
| 5,970,760 | A | | 10/1999 | Shen | |
| 6,014,877 | A | | 1/2000 | Shen | |
| 6,532,779 | B2 | | 3/2003 | Shen | |
| 7,100,408 | B2 | | 9/2006 | Nakasone | |
| 7,389,660 | B2 | * | 6/2008 | Ebling | E05B 9/08 70/370 |
| 9,476,226 | B2 | * | 10/2016 | Wheeler | E05B 9/084 |
| 2002/0026817 | A1 | * | 3/2002 | Greer | E05B 9/084 70/370 |
| 2012/0000257 | A1 | | 1/2012 | Wheeler et al. | |

OTHER PUBLICATIONS

Crowe, William, "Patents Act 1977: Search Report Under Section 17(5)," for Application No. 1300430.4, filed Jan. 10, 2013, South Wales, New Port, United Kingdom.

* cited by examiner

LOCK ASSEMBLY WITH AN INTERCHANGEABLE LOCK CORE

CROSS-REFERENCE TO RELATED APPLICATIONS

This application is a continuation of U.S. patent application Ser. No. 13/737,580, filed Jan. 9, 2013, which claims the benefit of U.S. Provisional Application No. 61/584,931, filed Jan. 10, 2012, which are both hereby incorporated by reference in their entirety.

TECHNICAL FIELD

The present invention relates to lock core assemblies with interchangeable lock cores; more particularly to such interchangeable lock cores that allow a door to be conveniently rekeyed without removal of the complete lock core assembly from a latch assembly; and most particularly, to a lock core assembly having an interchangeable lock core wherein the assembly may be flush mounted into the door for added security. The present invention includes a replaceable core component with a secure quick-release mechanism and a means for securing a lock core assembly to a latch assembly without a threaded interface.

BACKGROUND OF THE INVENTION

There currently exists in the market interchangeable cores (ICs) for lock core assemblies that allow a door to be quickly re-keyed without removing a cylindrical lock core assembly from a door. A special "change" key allows the IC to be readily removed from the cylindrical housing of the assembly without removal of the lock core assembly from the door. A standard key inserted in the IC allows rotation of the cylinder to disengage a latch from an associated strike. The prior art IC component of the lock core assembly includes a cylindrical IC housing, an IC insert and the IC itself. A "cam" is attached to the IC component for rotation with the IC. The cam acts on a locking train provided in the latch assembly to unlock the latch. Threads are formed on the outer surface of the cylindrical housing and the IC component is screwed into the latch assembly to secure it in place.

Although, this design has served the industry well, there exist many drawbacks to this design. For example, the lock core assembly of the prior art design extends beyond the outer surface of a narrow stile door thereby exposing the assembly to outside lateral forces. It would be beneficial from both a security and aesthetics perspective if the device could be flush on both sides of the door, or at least on the "secure side" of the door. (The term "secure side" as used herein means the side of the door that could be exposed to unwanted intruders). Also, since the prior art housing is threaded on its outside surface for assembling into the latch assembly, the housing requires extensive machining, is expensive to manufacture and the threads can be damaged during installation. Further, since the prior art housing is cylindrical in shape, the lock core assembly is vulnerable to a forced twisting by an intruder to break it free from the latch assembly.

Still further, because of the design of the prior art locking train wherein a lever component partially blocks the opening that receives the lock core assembly, the housing of the lock core assembly must be formed into two sections in order for it to be installed into the latch assembly, thereby increasing part costs and costs of installation.

Finally, often times it is necessary to replace a thumb-turn component on the non-secure side with a key lockable component so that a key lock is provided on both sides of the lock core assembly. In the prior art, this task often resulted in having to exchange the entire lock core assembly which is time consuming, labor intense and costly.

It is a principal object of the present invention to provide a flush-mounted lock core assembly that is less vulnerable than prior art assemblies to tampering by hammer blows made either radially or axially.

It is a still further object of the present invention to increase the versatility of a lock core assembly in a plurality of lock configurations.

It is a still further object of the present invention to provide a lock core assembly having a non-cylindrical housing that inherently resists forced twisting.

It is a still further object of the present invention to install a lock core assembly into a latch assembly without the use of threads.

SUMMARY OF THE INVENTION

In one aspect of the invention, a lock core assembly is flush mounted to a door on its key lock side. The benefit of the flush mounted feature is improved lock integrity and security; that is, it protects the sides of the lock from being struck with a hammer. In one aspect of the invention, the lock core assembly may be pre-assembled as a unit and installed from one side of the door. This simplified mode of assembly is enabled by the latch assembly locking train disclosed in pending U.S. patent application Ser. No. 12/803,585 (the "Reference Application"), assigned to Adams Rite Manufacturing Co., which is hereby incorporated by reference in its entirety. The novel locking train disclosed in the Reference Application has no elements of the locking train projecting into the opening provided for receiving the lock core assembly that would otherwise prevent insertion of the lock core assembly to its assembled position from one side of the door. Also, because the length of the housing of the lock core assembly is full fitting within the door stile, that is, the inner face of the housing is close to touching the inner face of the stile when assembled into the stile, hammer blows directed axially at the IC that would otherwise have to be absorbed by the lock core assembly attachment to the lock core/latch assembly, are transmitted through the housing and are absorbed by the stile structure itself.

To accommodate the flush mount of the lock core assembly, the axial length of the IC component must extend inwardly, well past the center point of the door thickness. In another aspect of the invention, an offset cam is used at the end of the IC component to bring the cam legs that contact the locking train of the latch assembly back on center. In this embodiment, a first offset cam is swaged to the IC component and a second cam is swaged to the thumb-turn component so that the cams can be turned independently. Since the offset legs of the cams would make contact with the IC component if a full rotation of the cams of 360 degrees were permitted (as in the prior art), the cams and locking train are designed to operate the latch through less than a 360 degrees rotation.

In another aspect of the invention, a means for securing the thumb-turn component to the lock core assembly, yet affording a convenient and secure way of removing the thumb-turn component for replacement is provided. In accordance with the present invention, removal/replacement of the thumb-turn component would include first removing the IC component using the special "change" key as in the prior art. Once the IC component is removed, an access hole is exposed on the inner face of the thumb-turn component into which a tool can be inserted to move a locking plug in a direction to unlock and release the thumb-turn component from the housing. In this way, the thumb-turn component cannot be removed from the unsecured side of the door without first removal of the IC component through the use of the special "change" key from the other side. If desired, the removed thumb-turn component can then be replaced with a second IC component (if a key lock on both sides of the door is desired) or by another thumb-turn component (if a key lock is needed on only one side).

In yet another aspect of the invention, interlocking features provide a means to secure a lock core assembly housing into a conventional latch assembly without the use of a threaded connection between the housing and assembly. Interacting dogs in the housing cause the lock core assembly to be secured in place in the latch assembly as the IC is inserted into the housing.

BRIEF DESCRIPTION OF THE DRAWINGS

The present invention will now be described, by way of example, with reference to the accompanying drawings, in which.

Corresponding reference characters indicate corresponding parts throughout the several views. The exemplifications set out herein illustrate currently preferred embodiment of the invention, and such exemplifications are not to be construed as limiting the scope of the invention in any manner.

DESCRIPTION OF THE PREFERRED EMBODIMENTS

Figure 1:
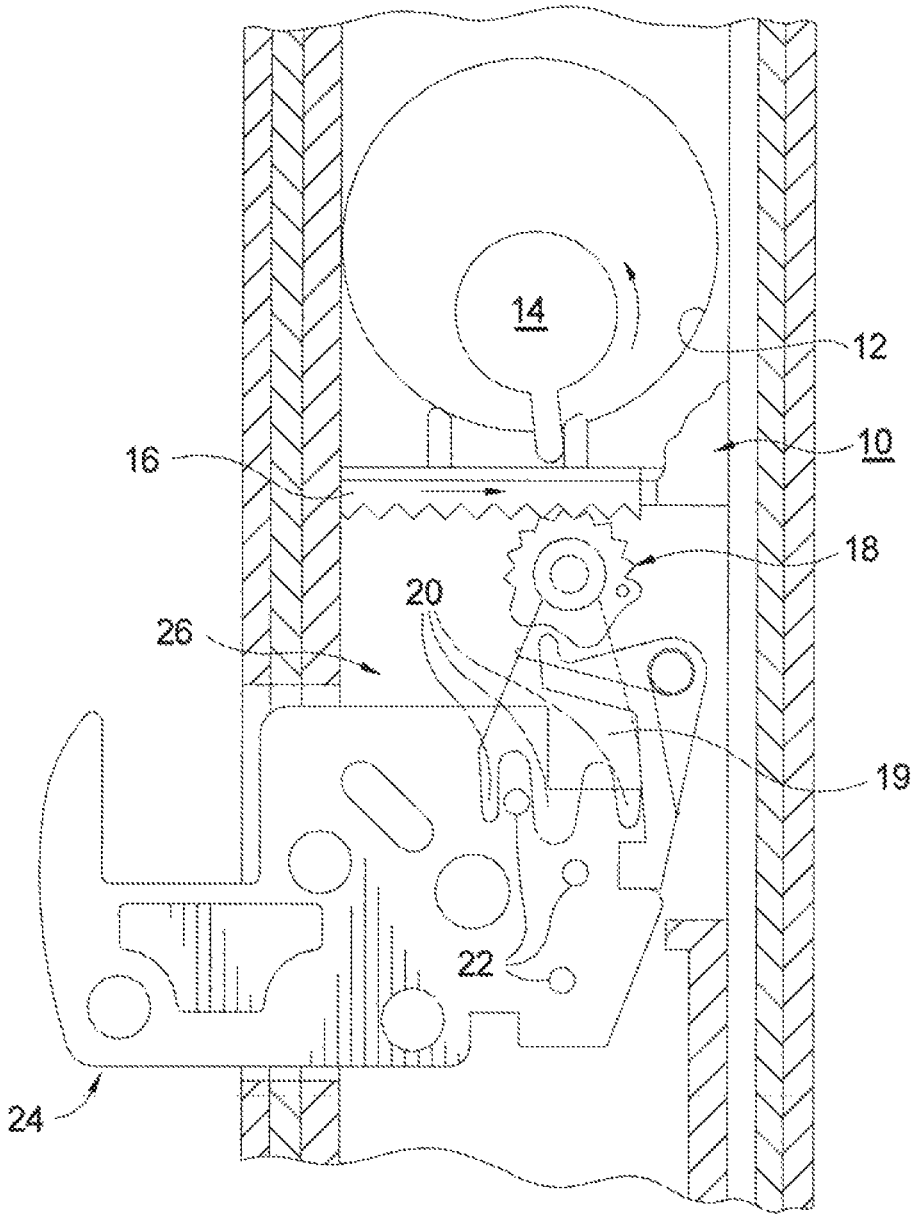
FIG. 1 is a front view of the latch assembly disclosed in the Reference Application with its cover removed showing its locking train.

The overall invention contained in the Reference Application is directed toward a lock core/latch assembly (LCLA) for installation into an opening in a door known in the art as a "door stile". The LCLA has a lock core assembly with an interchangeable core (IC) so that the lock mechanism can be readily re-keyed. The lock core assembly includes a housing and, within the housing, an IC component (key lock) on the secure side and typically a thumb-turn component on the opposite side. The IC component includes an IC insert and the replaceable IC disposed in a lock core channel. An outer peripheral surface of the lock core assembly defines a maximum outer profile footprint of the assembly. Referring to FIG. 1, latch assembly 10 disclosed in the Reference Application includes clearance opening 12 for receiving the lock core assembly. The clearance opening is sized to receive the outer profile footprint of the lock core assembly. While the opening in FIG. 1 is shown as circular, it is understood that the opening can be any shape and needs only to provide clearance for the lock core assembly to pass through the opening. Rotation of either the key lock core (not shown) or the thumb-turn (not shown) rotates a cam 14 that drives a rack 16 which in turn rotates a spur gear 18. Rotation of spur gear 18 rotates lever 19. Downward facing fingers 20 projecting from lever 19 acts on pins 22 extending laterally through the latch plate 24, causing the latch plate to be selectively rotated between an unlocked position and a locked position.

One aspect of the invention shown in FIG. 1 is that the locking train 26 of the latch assembly shown has no elements that project into the opening 12 provided to receive the lock core assembly. In the prior art latch assembly 110 (FIG. 2), lever 120 of the locking train 126 pivots about an axis above opening 112 thereby partially blocking the opening. Thus, because of the blockage by the lever, a lock core assembly cannot be inserted into the latch assembly as one piece from one side of the assembly but must be installed into the assembly in two sections from both sides. In accordance with one aspect of the invention, a method of assembling a core assembly to a latch assembly wherein the latch assembly includes an opening for receiving the core assembly and wherein the opening is substantially unimpeded by components of the locking train may include the steps of: (1) preassembling a core assembly including a housing having a first end and a second end, wherein a first locking component is associated with the first end and a second locking component is associated with the second end; (2) providing a latch assembly having a locking train and an opening for receiving the housing of the core assembly; and (3) inserting one of the first end or second end of the housing of the core assembly into the opening so that a substantial length of the housing passes entirely through the opening, whereby the first locking component is accessible from a first side of the door and the second locking component is accessible from a second side of the door. In this method, the housing may be inserted into the opening from either the first side of the door or the second side of the door. The first and second locking components may be either an IC component or a thumb-turn component.

Figure 2:
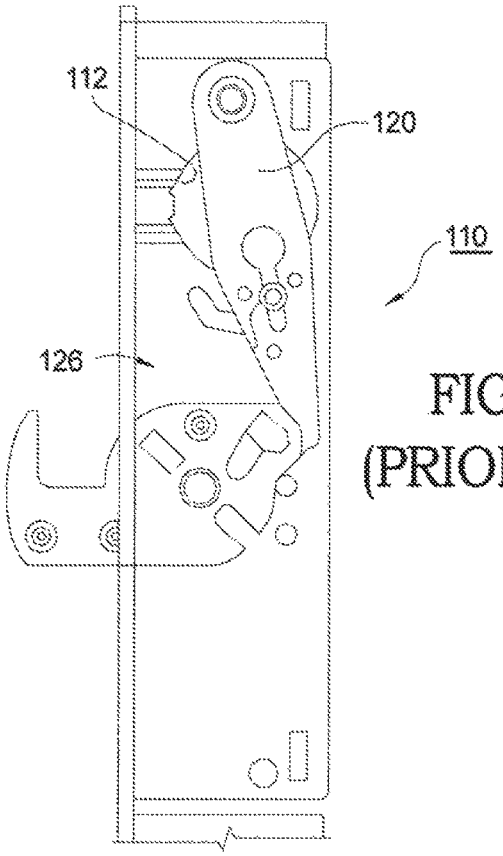
FIG. 2. (PRIOR ART)
FIG. 2 is a front view of a prior art latch assembly with its cover removed showing the locking train of the latch assembly.
Figure 3:
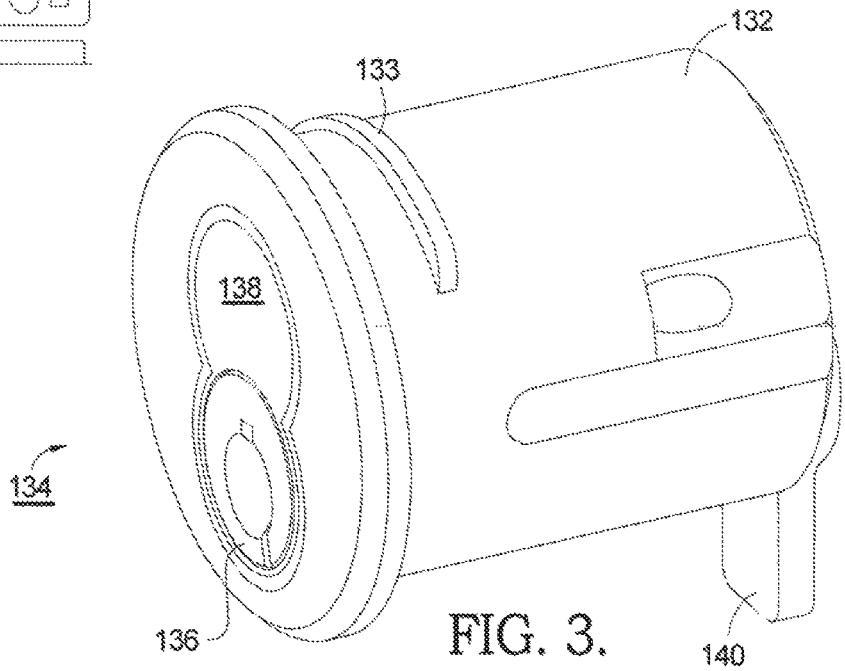
FIG. 3. (PRIOR ART)
FIG. 3 is an isometric view of a prior art threaded lock core half showing the housing, the IC, the IC insert and the cam.

Referring now to FIG. 3, an IC component 134 of a two piece lock core assembly is shown. IC component 134 includes cylindrical housing 132 having external threads 133, an IC insert 138, an IC 136, and a cam 140 that is rotatable by the IC to act in conjunction with locking train 126 in latch assembly 110 (FIG. 2). IC component 134 would be inserted into opening 112 from one side of latch assembly 110. The other half of the two piece latch core assembly would be inserted into opening 112 from the other side of latch core assembly 110 to complete the full assembly of the two piece lock core assembly. As noted above, it would be beneficial if the lock core assembly could be installed as a unit from one side of the latch assembly. It would also be beneficial if the lock core assembly could be mounted flush on at least the secure side of the door and if the lock core assembly could be secured to the latch assembly without threads. Also, it would be beneficial if the thumb-turn component could be held secure but easily removable from the housing for replacement.

Flush-Mounted Lock Core Assembly

Figure 4:
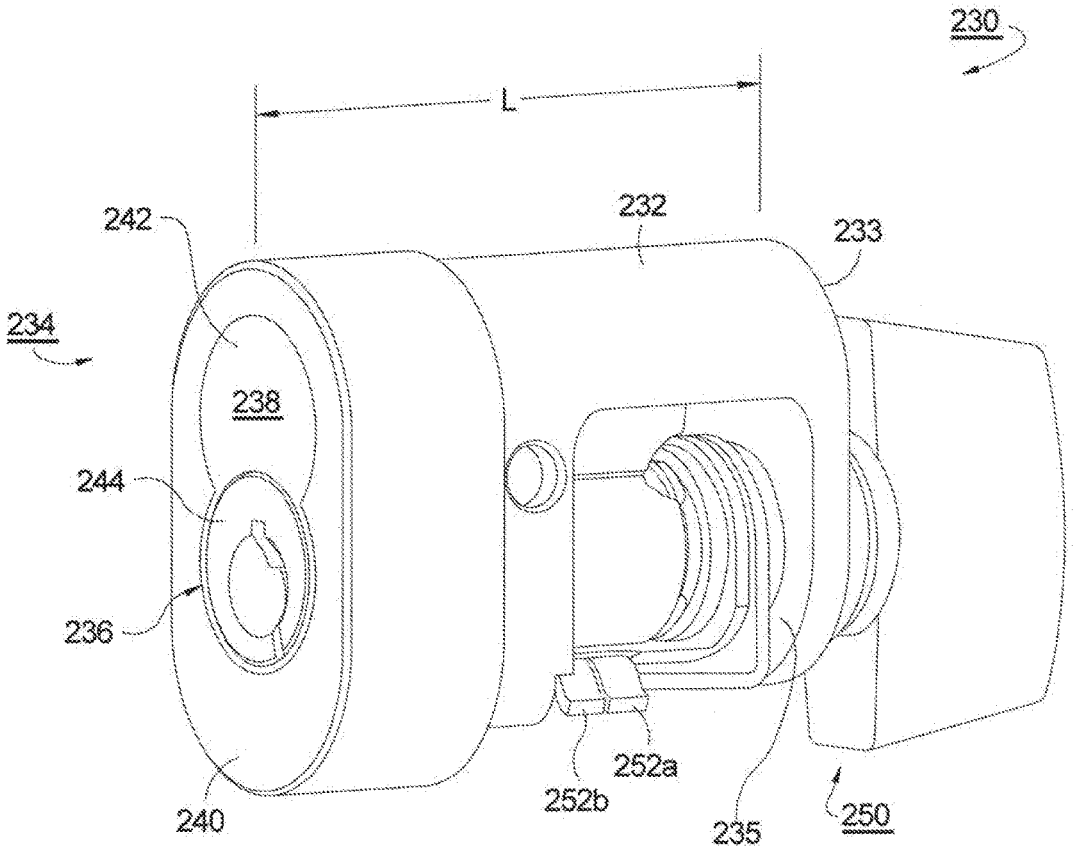
FIG. 4 is an isometric view of a one piece lock core assembly having a non-cylindrical housing, in accordance with the invention.
Figure 5:
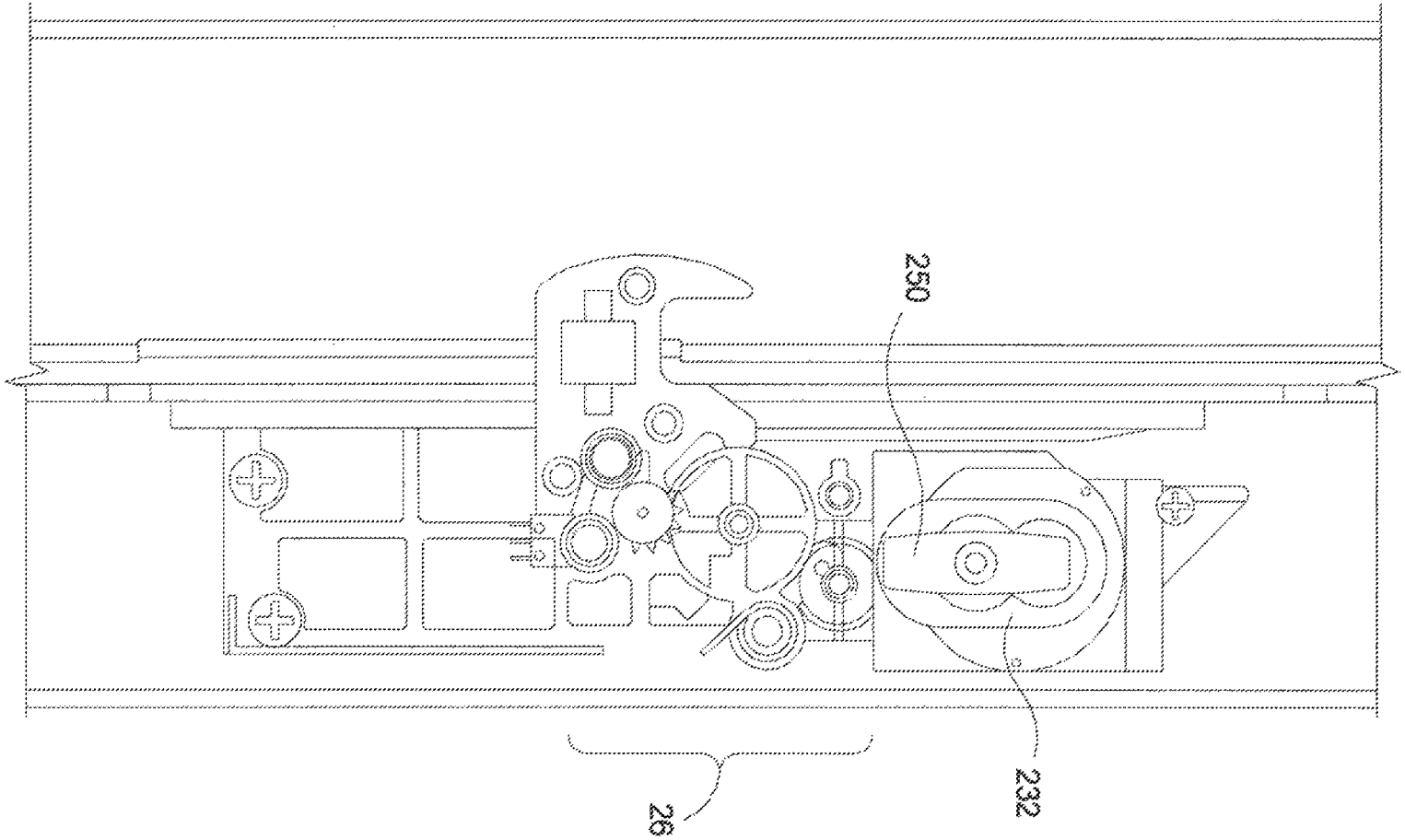
FIG. 5 is a side view showing the lock core assembly shown in FIG. 4 installed in a latch assembly.
Figure 6:
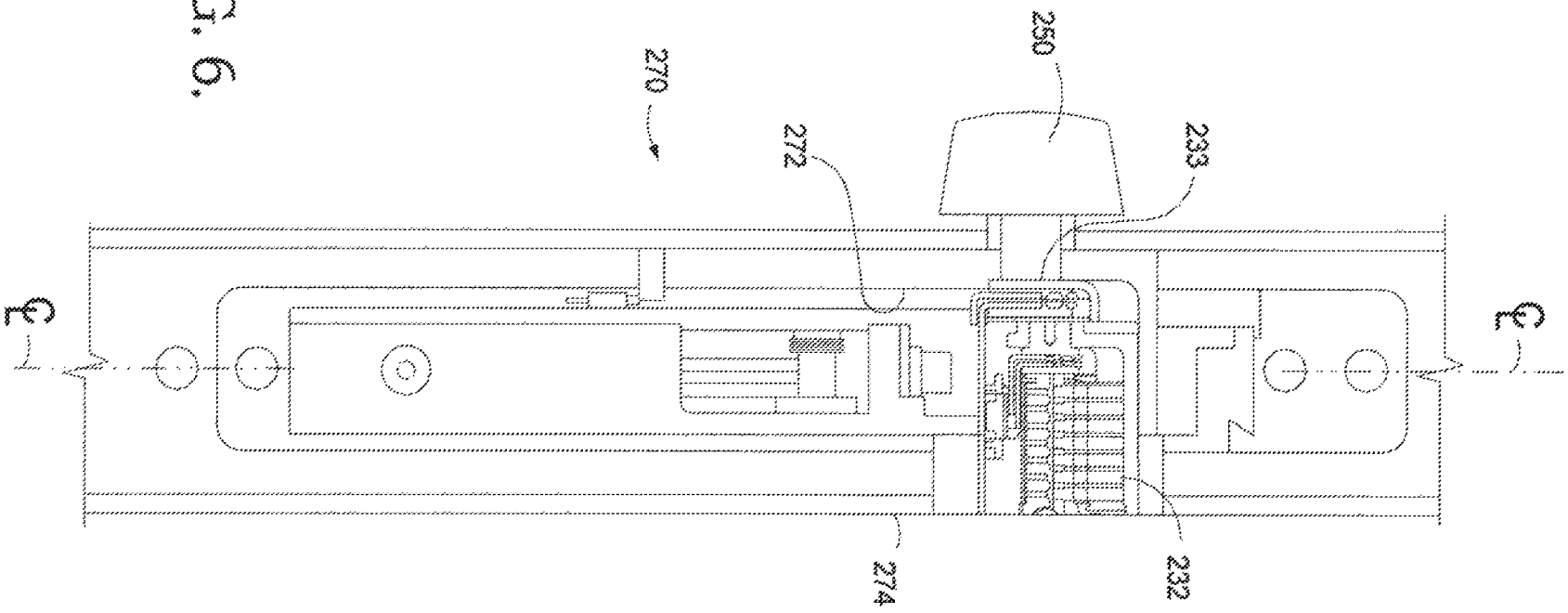
FIG. 6 is an end view of the arrangement shown in FIG. 5.

Referring now to FIGS. 4 through 9, a one piece lock core assembly 230 in accordance with the present invention for mounting in a latch assembly as disclosed in the Reference Application is shown. Lock core assembly 230 is comprised of IC component 234, having housing 232, IC insert 238, IC 236. On the opposite side of IC component 234 and coaxial with IC 236 is thumb-turn component 250. Housing outermost face 240, IC insert outermost face 242 and IC outermost face 244 are substantially coplanar. Housing 232 of assembly 230 is not threaded and is mounted in the latch assembly as described in the Reference Application or as described below in accordance with the invention under heading "Interlocking attachment of a lock core assembly." Housing 232 may be circular but need not be because it is not threaded. In one aspect of the invention, the cross-section of the housing is not circular but is elongated or elliptical, as shown, and is full-fitted into a similarly shaped clearance opening in the latch assembly, to prevent the lock core assembly from being twisted free from its mounting by an intruder. When installed in the door stile, the collective outermost faces 240, 242 and 244 are substantially flush with an outer surface 274 of the stile 270 (FIGS. 4 and 6). And, as noted above, because of the one piece design of assembly 230, it may be conveniently installed from one side of the latch assembly shown in FIG. 1.

In accordance with the invention, thumb-turn component 250 is coaxial with IC 236, permitting a door utilizing lock core assembly 230 to be unlatched either with a key in IC 236 from the secure side or by thumb-turn component 250 from the non-secure side of the door. Thumb-turn component 250 and IC 236 are free to be turned independently of one another; therefore, each is provided with its own respective cam for engaging rack 16 of locking train 26 as disclosed in the Reference Application and shown in FIG. 1. First cam 252*a* (FIGS. 4, 6A, 7 and 9) is fixed to thumb-turn component 250 for rotation therewith, and second cam 252*b* (FIGS. 4, 6A, 8 and 9) is fixed to IC 236 for rotation therewith.

Figure 6A:
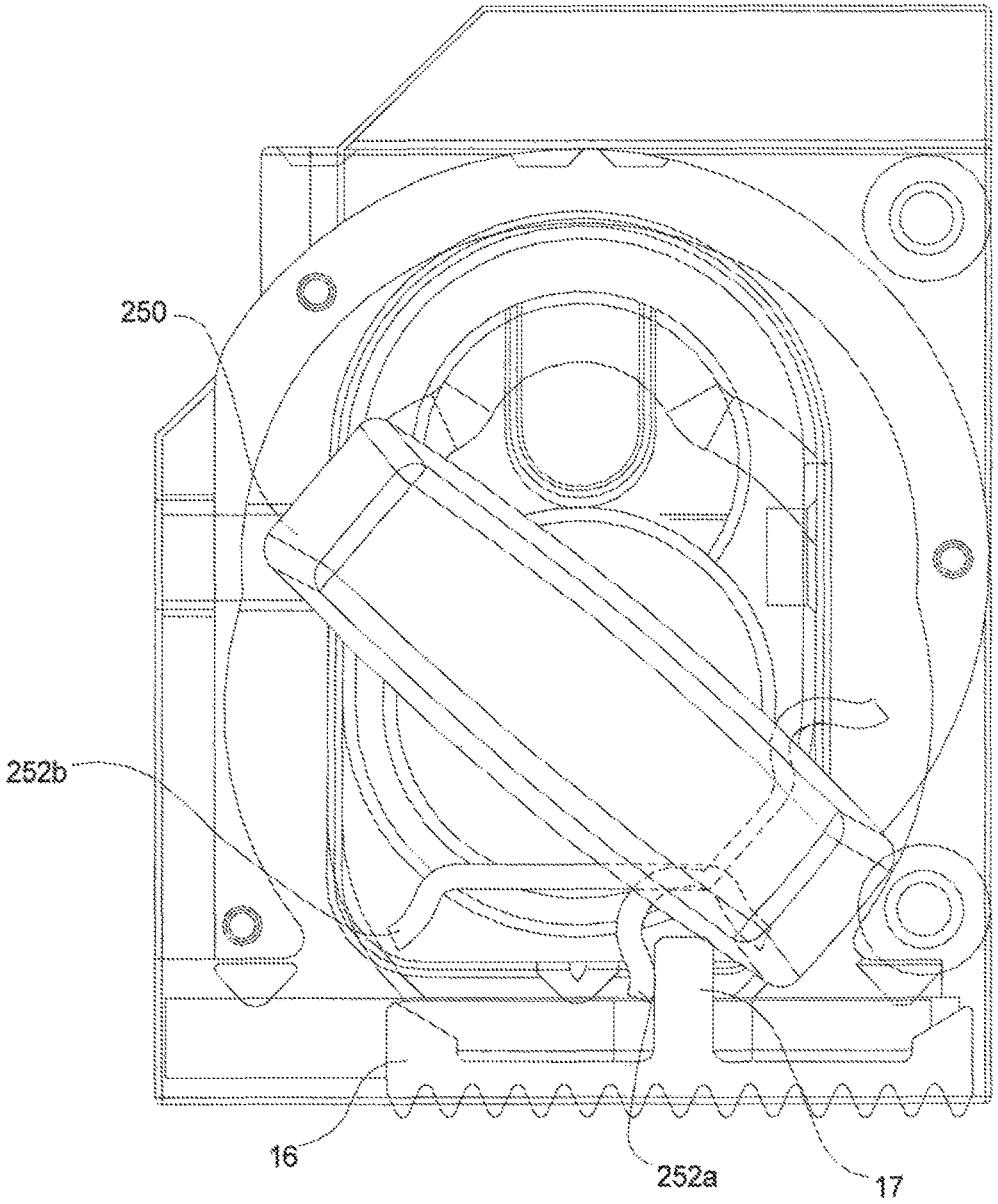
FIG. 6A is an enlarged side view of the lock core assembly shown in FIG. 6, showing the mechanism unlocked by the thumb-turn assembly and the radial positioning of the cam shown in FIG. 7.
Figure 7:
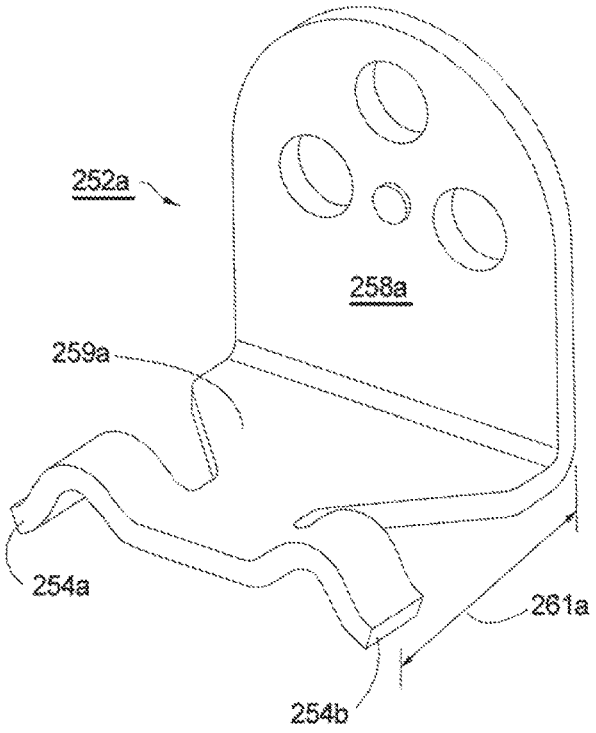
FIG. 7 is an isometric view of a first cam actuable by the thumb-turn.
Figure 8:
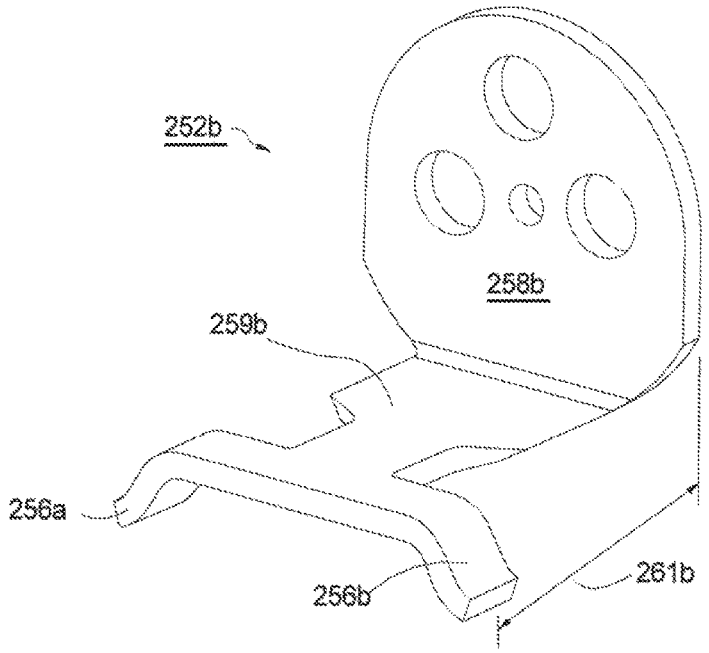
FIG. 8 is an isometric view of a second cam actuable by the IC key lock.
Figure 9:
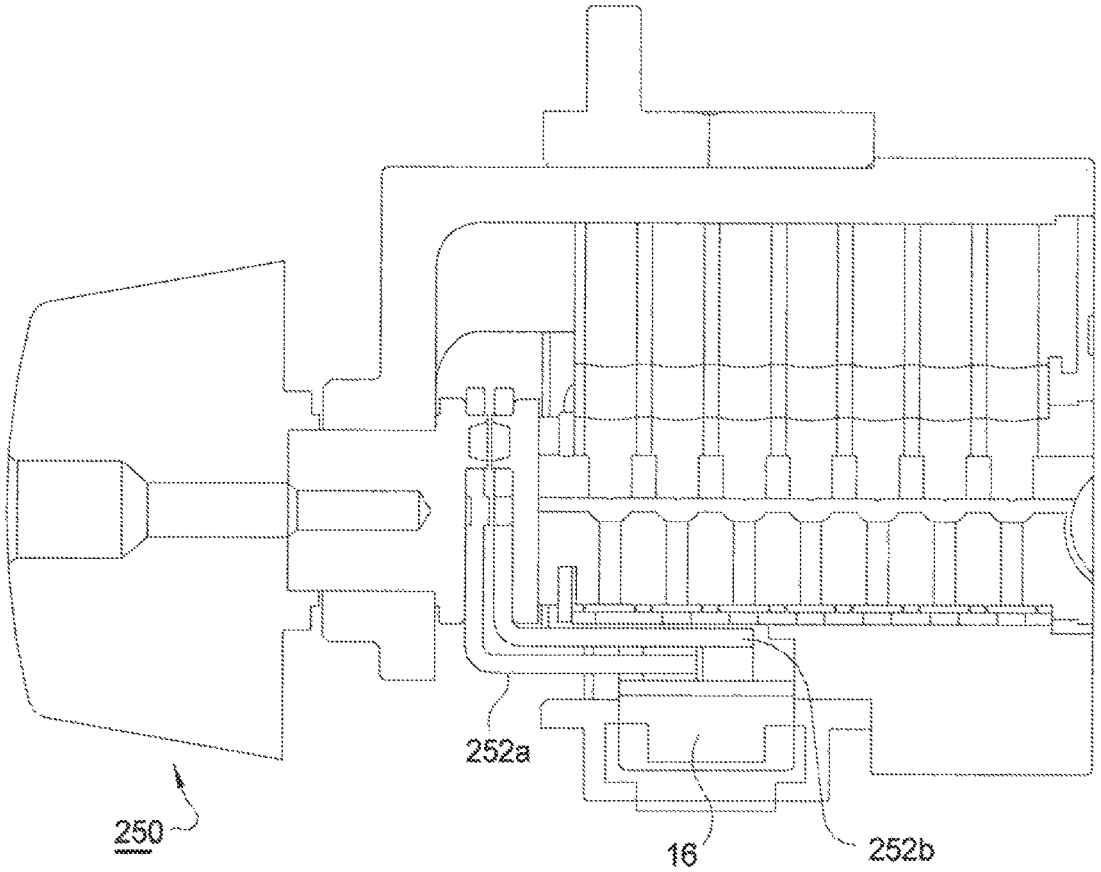
FIG. 9 is a cross-sectional side view of the thumb-turn end of the lock core assembly in accordance with the present invention showing the off-set cams interacting with the locking train.

Unlocking by rotation of thumb-turn component 250 and first cam 252*a* is shown in FIGS. 6A, 7 and 8. Rack 16 includes a projecting longitudinal flange 17. Each of first and second cams 252*a*, 252*b* includes respective generally first planar surfaces 258*a*, 258*b*, respective second surfaces 259*a*, 259*b* disposed at an angle (for example, perpendicular) relative to the first surfaces 258*a*, 258*b*, and respective pairs of first and second legs 254*a*, 254*b*, and 256*a*, 256*b*. First planar surface 258*a* may be spaced apart and adjacent to first planar surface 258*b*, and first planar surfaces 258*a*, 258*b* of first and second cams 252*a*, 252*b* may be disposed generally parallel to one another. Each pair of legs is disposed in a plane that is offset a distance 261*a*, 261*b* from its respective planar surface and each pair straddles flange 17 of rack 16. Noting that flush-mounting of the IC component places the inner face 233 of the IC component and its cam interface 235 well beyond the center of the stile (FIGS. 4 and 6), an important aspect of the present invention is that the offset L shape of the cams allows the legs to engage flange 17 at a central position within the latch assembly. Note further that cam 140 of the prior art IC component shown in FIG. 3 is substantially flat and is disposed at the inner end of the IC component. As such, it clears the component if rotated 360 degrees and it may be rotated through 360 degrees to alternately lock and unlock the latch. Such rotation is neither possible nor required by the cam arrangement in lock core assembly 230 wherein the cams essentially toggle back and forth over a narrow range of rotation about the axis of thumb-turn component 250.

Referring again to FIG. 4, length L of lock core assembly housing 232 is full fitting in the recess provided for the lock core assembly in the door stile (FIG. 6) so that the inner face 233 of the housing (FIG. 4) is close to or touching the inner wall 272 of stile 270 (FIG. 6). Thus, a force from a hammer blow striking the lock core assembly axially will be absorbed by the inner wall of the stile instead of the mounting interface between the lock core assembly and the latch assembly. Moreover, since the secure side of the lock core assembly is flush mounted, a lateral force from a hammer blow cannot be exerted on the assembly.

Interchangeable Thumb-Turn Component

Figure 10:
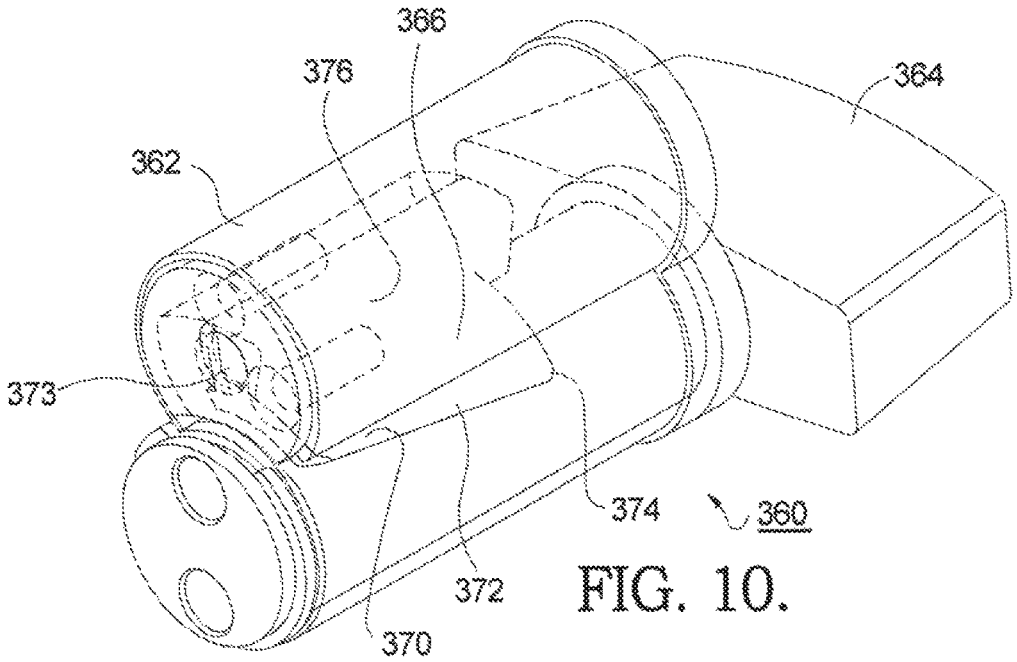
FIGS. 10 and 11 are isometric views of a removable thumb-turn component that can be inserted and secured into its housing as shown in FIG. 13 in accordance with the invention.
Figure 11:
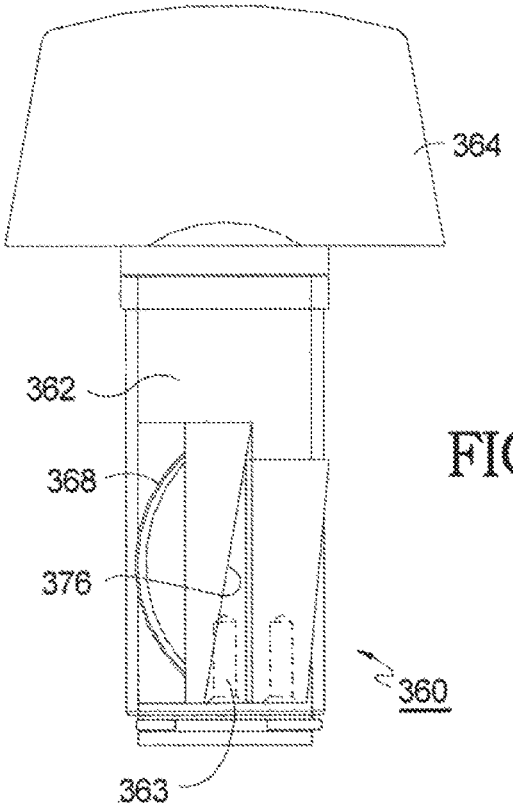

Referring now to FIGS. 10 and 11, a means is shown for increasing the versatility of a lock core assembly in a plurality of lock configurations so that the assembly can be conveniently changed from an IC/thumb-turn configuration to an IC/IC configuration without compromising the security of the lock core assembly. In a two piece IC/thumb-turn configured lock core assembly, the IC component containing IC and IC insert is disposed in the housing on one end of the lock core assembly and the thumb-turn component is axially aligned with the IC and disposed in the housing on the assembly's opposite end. As shown in FIGS. 10 and 11, thumb-turn component 360 as just described includes component housing 362 and thumb-turn lever 364. Thumb-turn lever 364 is secured within the housing and its removal from the housing is prevented without first removing the opposing IC (not shown) from its housing using the special "change" key as discussed above. Removal of the IC from its housing exposes opening 363 (FIG. 11) into which a tool (not shown) can be inserted to move locking plug 366 in a direction to unlock and release thumb-turn lever 364 from its housing 362. In this way, thumb-turn lever 364 cannot be removed without use of the special key and removal of the IC from the other side. The removed thumb-turn lever can then be replaced with either a second IC providing for a key lock on both sides of the door or with a replacement thumb-turn lever. FIG. 10 shows a thumb-turn lever 364 inserted into and retained by its housing 362 in a way similar to how an IC can be retained in its housing. Locking plug 366 with a ramped camming surface is biased into a locked position by a "U" shaped leaf spring 368. When the thumb-turn lever 364 is inserted into the housing, helical surface 370 biases locking plug 366 into an unlocked position until barb 372 of thumb turn lever 364 aligns with its mating ledge 374 in the housing. At that point, the locking plug can snap into a locked position engaging the ledge with the barb with help of leaf spring 368. Opening 363 in housing 362 allows a pin to be inserted from the secure/opposite side of the door that acts against a second helical surface 376 that rotates/retracts locking plug 366, thereby retracting barb 372 from ledge 374 and allowing thumb-turn lever 364 to be removed from the housing. In accordance with the invention, a thumb-turn component can be exchanged quickly, without exchanging the entire lock core assembly and the thumb-turn component can be removed only by someone with a change key for the keyed IC.

Interlocking Attachment of a Lock Core Assembly

Figure 12:
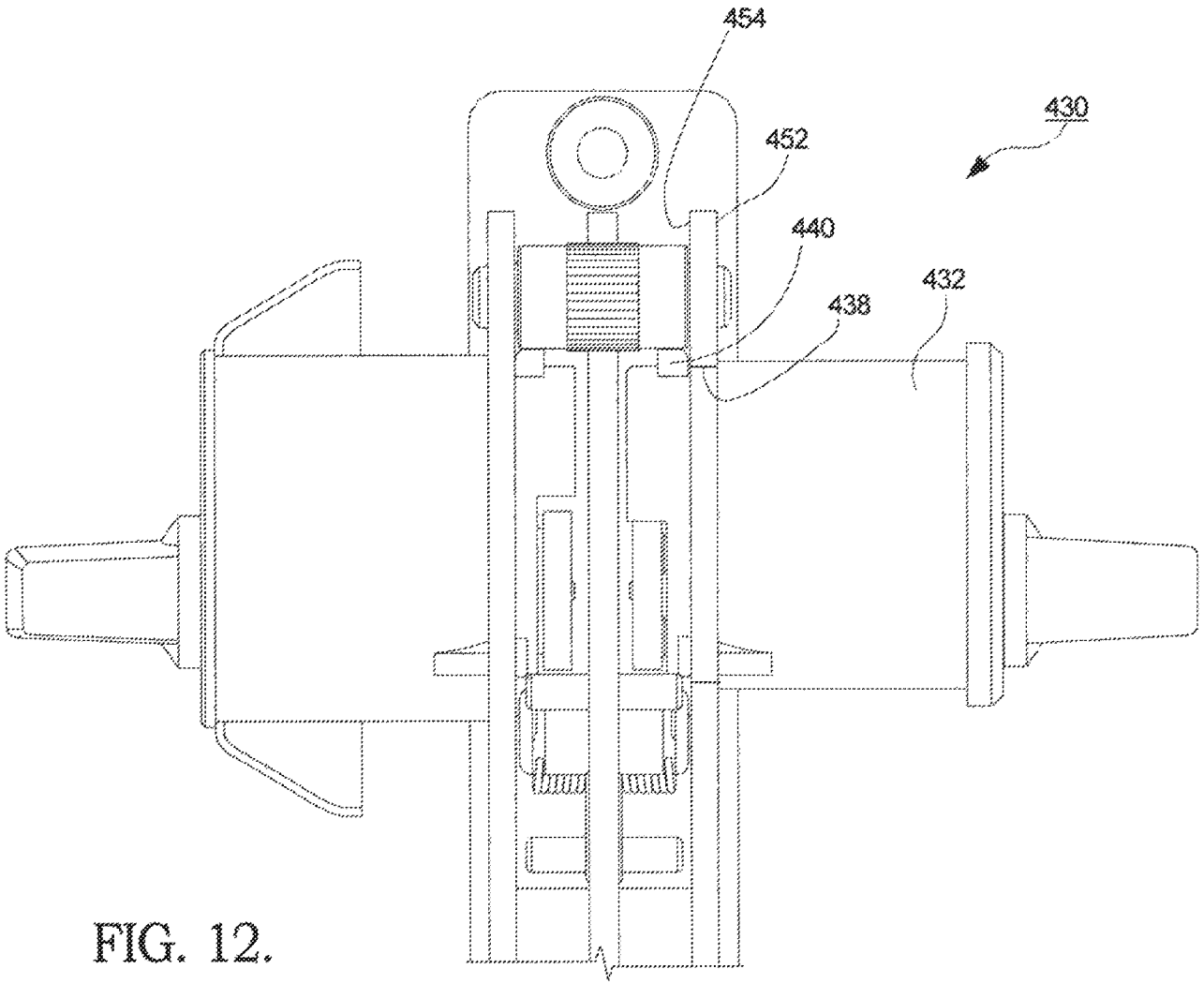
FIG. 12 is a side view of a two piece lock core assembly with cylindrical housings mounted in a latch assembly employing locking dog mechanisms to secure the housings in the latch assembly in place of conventional threading.
Figure 13:
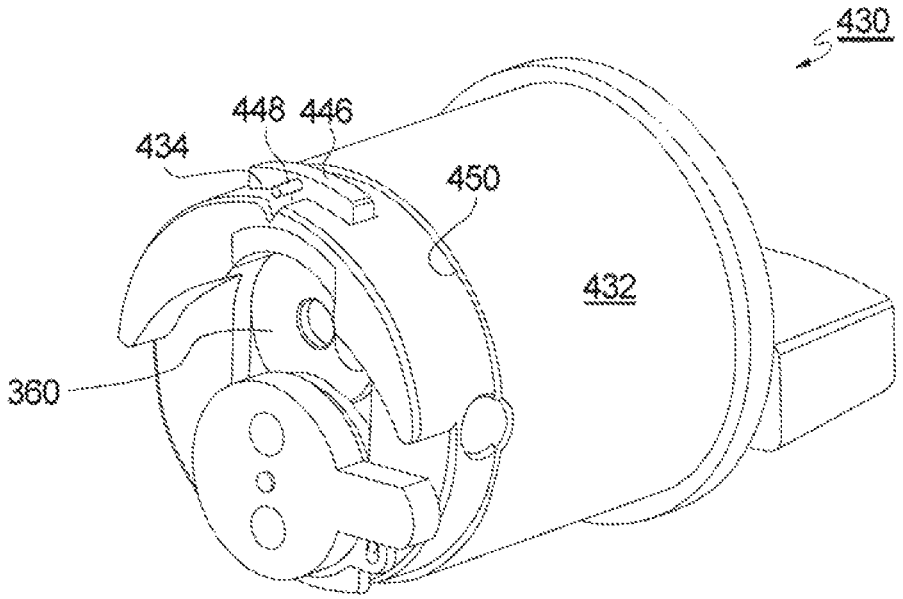
FIG. 13 is an isometric view of the thumb-turn core assembly half of the lock core assembly shown in FIG. 12, showing pins to trap the locking dogs rotationally in place.
Figure 14:
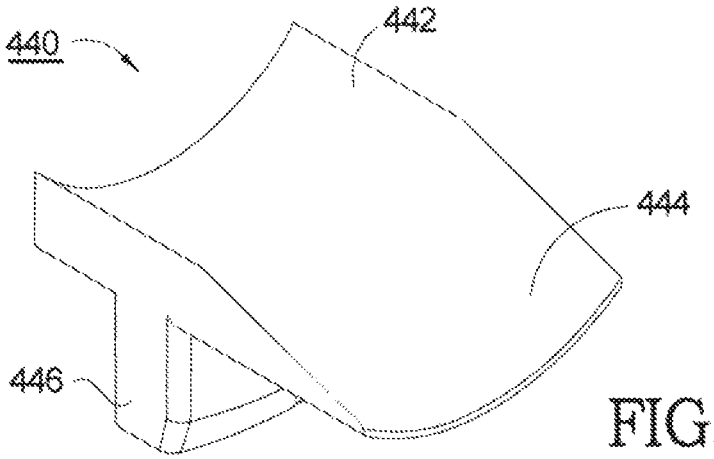
FIG. 14 is an isometric view of a locking dog having a ramp that forces the locking dog radially outwards when the thumb-turn core is inserted into the housing.

Referring now to FIGS. 12 through 14, a lock core assembly in accordance with the present invention may be secured into a latch assembly without requiring threads on either assembly, whether with the prior art IC component (FIG. 3) or the IC component configuration shown in FIG. 4. This important advantage simplifies the manufacture of the lock core housing and latch assembly. Accordingly, the housing may be net formed—i.e., requiring little or no machining—inexpensively at less demanding tolerances.

Thumb-turn core assembly half 430 includes housing 432 and is provided with at least one (and preferably two in opposed positions) locking dogs 440 having a generally cylindrical shoe portion 442, including an arcuate ramp 444 on the underside, and an ear 446 extending through a slot 434 formed in housing 432. Core assembly 430 includes a through-pin 448 for retaining locking dog 440 in slot 434 before thumb-turn component 360 of FIG. 10 is installed into housing 432. Prior to insertion of the thumb-turn component, housing 432 is inserted into an opening in the latch assembly when the locking dog 440 is in a retracted position for receiving the lock core assembly. A small annular step 450 formed in the outer surface of housing 432 butts against an outer face 452 of a peripheral edge 438 of the latch assembly opening, thereby properly positioning the housing in the latch assembly, axially, in its full-in position. When thumb-turn component 360 is inserted into housing 432, component 360 slides up ramp 444, thereby driving locking dog 440 radially outward. With the insertion of component 360 into the housing, locking dog 440 is driven radially outward to an extended position, and ear 446 is captured behind an inner face 454 of peripheral edge 438 of the latch assembly opening, thereby securely attaching core assembly 430 to the latch assembly without any threaded surfaces. Further, annular step 450 and ear 446 may be spaced apart a distance equal to a width of peripheral edge 438 so that core assembly 430 does not move relative to latch assembly after installation. If desired, a set screw may be driven through the latch assembly against housing 432 to secure core assembly 430 in place, radially. While this feature is described as having a threadless housing and latch assembly opening, it is understood that that the invention could be used as well with a threaded latch assembly opening wherein the threads are not used to secure the lock core assembly to the latch assembly. Also, it is understood that the invention can be used to secure a lock core assembly half into the latch assembly, similarly as described above for securing a thumb-turn core assembly. Also, this invention, as described, can be adapted to secure a one piece assembly (FIG. 4) to the latch assembly.

In accordance with one aspect of the invention, a method of assembling a core assembly to a latch assembly, wherein the latch assembly includes an opening for receiving the core assembly, may include the steps of (1) providing a core housing having at least one locking dog and a longitudinal receptacle for receiving a core component; (2) inserting the core housing into the opening in the latch assembly; (3) inserting the core component into the receptacle; and (4) causing said at least one locking dog to secure the core assembly in the latch assembly by the insertion of the core component into the receptacle.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A flush-mounted lock core assembly connectable to a latch assembly in a door stile, the door stile having an outer surface and an opening for receiving the lock core assembly, the lock core assembly comprising:

a housing including an outermost face, an inner face; and a core including a core outermost face, wherein the housing includes a channel configured for receiving the core, and wherein when the opening of the door stile receives said lock core assembly, the outermost face of the housing is flush with the outer surface of the door stile.

2. A flush-mounted lock core assembly in accordance with claim 1 wherein when the opening in the door stile receives the lock core assembly, the outermost face of the housing and the core outermost face are flush with the outer surface of the door stile.

3. A flush-mounted lock core assembly in accordance with claim 1 further comprising a core insert including a core insert outermost face, wherein when the opening in the door stile receives the lock core assembly, the outermost face of the housing, the core outermost face, and the core insert outermost face are flush with the outer surface of the door stile.

4. A flush-mounted lock core assembly in accordance with claim 3 wherein the core is an interchangeable core, and wherein the core insert is an interchangeable core insert.

5. A flush-mounted lock core assembly in accordance with claim 1 wherein the housing includes a cross-sectional shape, and wherein the cross-sectional shape is circular.

6. A flush-mounted lock core assembly in accordance with claim 1 wherein the housing includes a cross-sectional shape, and wherein the cross-sectional shape is non-circular.

7. A flush-mounted lock core assembly in accordance with claim 6 wherein the latch assembly includes an opening for receiving the lock core assembly, and wherein the latch assembly opening is shaped similarly to the cross-sectional shape of the housing to prevent the latch core assembly from being twisted relative to the opening of the latch assembly.

8. A flush-mounted lock core assembly in accordance with claim 6, wherein the cross-section shape is elongated.

9. A flush-mounted lock core assembly in accordance with claim 6, wherein the cross-section shape is elliptical.

10. A flush-mounted lock core assembly in accordance with claim 1 wherein the housing includes an outer surface, and wherein the outer surface of the housing is not threaded.

11. A flush-mounted lock core assembly in accordance with claim 1 wherein the housing includes a length measured between the outermost face of the housing and the inner face of the housing, wherein the door stile includes an inner wall, and wherein when the opening in the door stile receives the lock core assembly, the inner face of the housing is close to or touching the inner wall of the door stile.

12. A flush-mounted lock core assembly in accordance with claim 11 wherein the door stile includes a recess for receiving the housing, and wherein the length of the housing is full fitting in the recess when the door stile receives the lock core assembly.

13. A flush-mounted lock core assembly in accordance with claim 1 wherein the core is an interchangeable core.

* * * * *